US008287019B1

(12) United States Patent
Guerin

(10) Patent No.: US 8,287,019 B1
(45) Date of Patent: Oct. 16, 2012

(54) ROLL CONTAINER

(76) Inventor: Phillip M. Guerin, Lawrence, MA (US)

( * ) Notice: Subject to any disclaimer, the term of this patent is extended or adjusted under 35 U.S.C. 154(b) by 0 days.

(21) Appl. No.: 13/181,615

(22) Filed: Jul. 13, 2011

(51) Int. Cl.
*A45F 5/10* (2006.01)

(52) U.S. Cl. ..... 294/148; 294/156

(58) Field of Classification Search ..... 294/16, 294/31.2, 27.1, 137, 119.2, 148, 156, 157; D6/518; D8/396; 206/397, 395, 409; 211/26, 211/30, 45
See application file for complete search history.

(56) References Cited

U.S. PATENT DOCUMENTS

| | | | | | |
|---|---|---|---|---|---|
| 404,596 | A | | 6/1889 | Caldwell | |
| 1,168,703 | A | | 1/1916 | Bauer | |
| 2,031,033 | A | | 2/1936 | Denebeim | |
| 3,166,187 | A | | 1/1965 | Araujo | |
| 3,337,044 | A | | 8/1967 | Smith et al. | |
| 3,796,305 | A | | 3/1974 | Beason | |
| 3,856,141 | A | | 12/1974 | Reed | |
| 3,912,872 | A | * | 10/1975 | Callens | 370/428 |
| 3,982,712 | A | | 9/1976 | Bassett | |
| 3,998,326 | A | | 12/1976 | McKee, Jr. | |
| 4,034,926 | A | | 7/1977 | Wegner | |
| 4,239,164 | A | | 12/1980 | Barnsbee et al. | |
| 4,274,573 | A | | 6/1981 | Finkelstein | |
| 4,310,110 | A | * | 1/1982 | Dexter | 224/246 |
| 4,754,996 | A | * | 7/1988 | Tecca et al. | 294/151 |
| 4,805,794 | A | | 2/1989 | Tsuchiya et al. | |
| 4,821,876 | A | | 4/1989 | Naito et al. | |
| 4,826,015 | A | | 5/1989 | Mandel | |
| 4,901,855 | A | | 2/1990 | Furukawa | |
| 4,957,246 | A | | 9/1990 | Kantor | |
| D313,752 | S | | 1/1991 | Dyble | |
| 5,038,934 | A | | 8/1991 | Higashiyama | |
| 5,284,247 | A | | 2/1994 | Turner | |
| D383,934 | S | * | 9/1997 | McNaughton | D6/518 |
| D394,572 | S | * | 5/1998 | Devaney | D6/518 |
| 5,819,935 | A | | 10/1998 | Lawson | |
| 5,867,969 | A | | 2/1999 | Quinones | |
| D419,015 | S | * | 1/2000 | Umemoto | D6/522 |
| 6,446,808 | B1 | | 9/2002 | Paul et al. | |
| 6,530,473 | B1 | | 3/2003 | St. Felix | |
| 7,306,100 | B1 | | 12/2007 | Eslambolchi et al. | |
| D576,433 | S | | 9/2008 | Che | |
| D585,514 | S | * | 1/2009 | Cresswell | D21/804 |
| D613,982 | S | | 4/2010 | Wilson et al. | |
| 8,056,947 | B2 | * | 11/2011 | Davidson | 294/16 |
| D653,887 | S | * | 2/2012 | Guerin | D6/518 |
| 2004/0004013 | A1 | | 1/2004 | Dieter et al. | |

* cited by examiner

*Primary Examiner* — Paul T Chin
(74) *Attorney, Agent, or Firm* — David M. Driscoll, Esq.

(57) ABSTRACT

A container for a roll of sheet metal material that includes a partially circular base and oppositely disposed end walls that are integrally formed with the base and that define with the base an open channel in which the roll of material is to be placed. An elongated slot is provided along the base and dimensioned so as to receive an end of the roll of sheet material for dispensing through the slot. An elastic cord is attached at opposite sides of the base and extend about the roll of material for holding the roll of material in the open channel.

21 Claims, 6 Drawing Sheets

ROLL CONTAINER

FIELD OF THE INVENTION

The present invention relates to containers, and pertains more particularly to an improved container construction that is particularly suited for supporting and dispensing roll material. Even more particularly the present invention relates to a container for supporting and dispensing a sheet metal roll.

BACKGROUND OF THE INVENTION

Sheet metal rolls are widely used in the construction business for a wide variety of applications including in the roofing field. These rolls are typically used, as is, with the result that the unused roll is found around the construction site in an unorganized manner. This also creates an unsafe situation in which sharp edges of the roll are exposed.

Accordingly, it is an object of the present invention to provide a dispensing container for a roll of sheet material, particularly metal sheet material.

Another object of the present invention is to provide a container for supporting and dispensing a sheet metal roll, and which is simple in construction, easy to use and can be made relatively inexpensively.

A further object of the present invention is to provide a roll container in which a particular method is used for the use of the container that allows ready insertion of the roll into the container, as well as ready dispensing of the sheet material from the roll.

SUMMARY OF THE INVENTION

To accomplish the foregoing and other objects of the present invention there is provided a container for a roll of material that includes a partially circular base and oppositely disposed end walls that are integrally formed with the base and that define with the base an open channel in which the roll of material is to be placed; an elongated slot provided along said base and dimensioned so as to receive therethrough an end of the roll of sheet material for dispensing thereof; and an elongated elastic cord attached at opposite sides of the base and extending about the roll of material for holding the roll of material in the open channel.

In accordance with other aspects of the present invention the elongated slot extends from one end wall to the opposite end wall; the elongated slot divides the base into semi-circular first and second base segments; including a first cord holder attached to the first base segment for retaining the elongated elastic cord; including a second cord holder attached to the second base segment for releasably holding the elongated elastic cord; including a pair of second cord holders that are spacedly disposed; each second cord holder has a projection that extends radially from the second base segment, and each projection has on one side thereof a lip for receiving the elastic cord; the second cord holder comprises a projection that extends radially from the second base segment; the projection has on one side thereof a lip for receiving the elastic cord; the projection has on another side thereof an indentation that forms a carry handle; the first cord holder has a through passage for receiving ends of the elongated elastic cord so as to retain the ends in place; including a pair of first holder that are spacedly disposed and that each have a through passage; the projection has on another side thereof an indentation that forms a carry handle; the first cord holder has a through passage for receiving ends of the elongated elastic cord so as to retain the ends in place; the elongated elastic cord has a free end that is looped over the projection and retained by the projection lip Also in accordance with the present invention there is provided a method of supporting and dispensing sheet metal from a roll that is disposed in a container for the roll, comprising the steps of: providing a partially circular base and oppositely disposed end walls that are integrally formed with the base and that define with the base an open channel and having an elongated slot provided along said base; placing said roll into said base with the slot constructed and arranged so as to receive therethrough an end of the roll of sheet material for dispensing thereof; and having an elongated elastic cord attached at opposite sides of the base and extending about the roll of material for holding the roll of material in the open channel.

Other aspects of the method of the present invention include the elongated slot divides the base into semi-circular first and second base segments, and attaching the cord a first cord holder for retaining the elongated elastic cord; including a second cord holder attached to the second base segment for releasably holding the elongated elastic cord; the second cord holder comprises a projection that extends radially from the second base segment; the projection has on one side thereof a lip for receiving the elastic cord; and the projection has on another side thereof an indentation that forms a carry handle.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION OF THE PREFERRED EMBODIMENTS

Reference is now made to the drawings and the first embodiment of the present invention illustrated in FIGS. 1-6. The container is comprised primarily of a partially circular base 10 and oppositely disposed end walls 12 and 14. The oppositely disposed end walls 12, 14 are preferably integrally formed with the base 10 and define with the base 10 an open channel 18 in which the roll 20 is secured.

Figure 1:
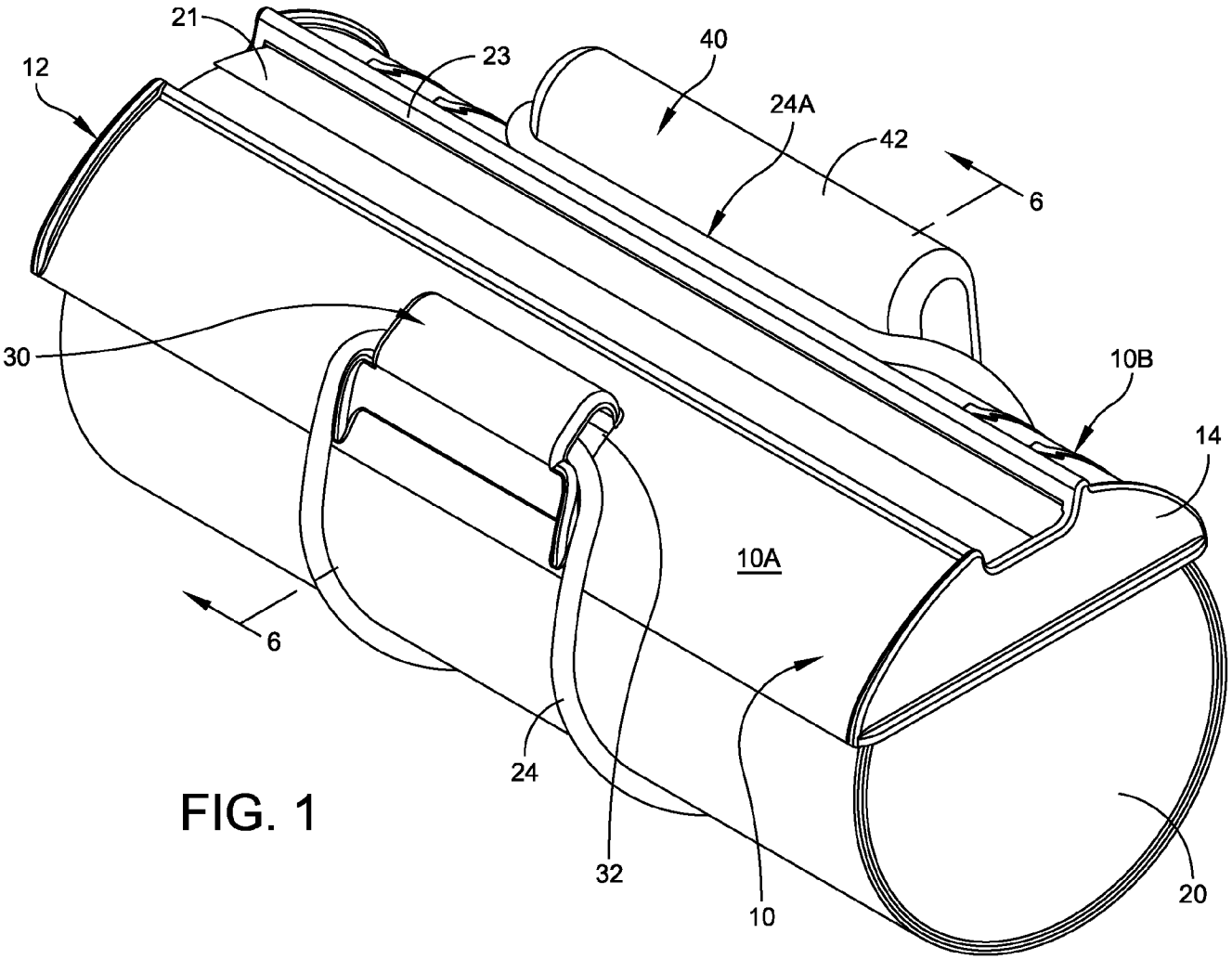
FIG. 1 is a perspective view of the roll container with a roll of metal material disposed therein.

An elongated and substantially centrally disposed slot 22 is provided. The slot 22 preferably extends from one end wall 12 to the oppositely disposed end wall 14. In FIG. 1, because the roll 20 is in place, an edge 21 of the roll is depicted as extending through the slot 22. An elongated elastic cord 24 is attached at opposite sides of the base and extends about the roll of material for holding the roll of material securely in the open channel 18.

The elongated slot 22 may have a width on the order of one inch and the base may have a length any where from 10 to 20 inches. An edge 23 at the slot 22 forms a guide for cutting a desired length of the sheet metal roll. The slot 22 essentially divides the base into semicircular first and second base segments 10A and 10B. Preferably on the segment 10B, there are provided directional arrows 11 that can be used to illustrate the direction that the roll is to be placed in the base.

Figure 2:
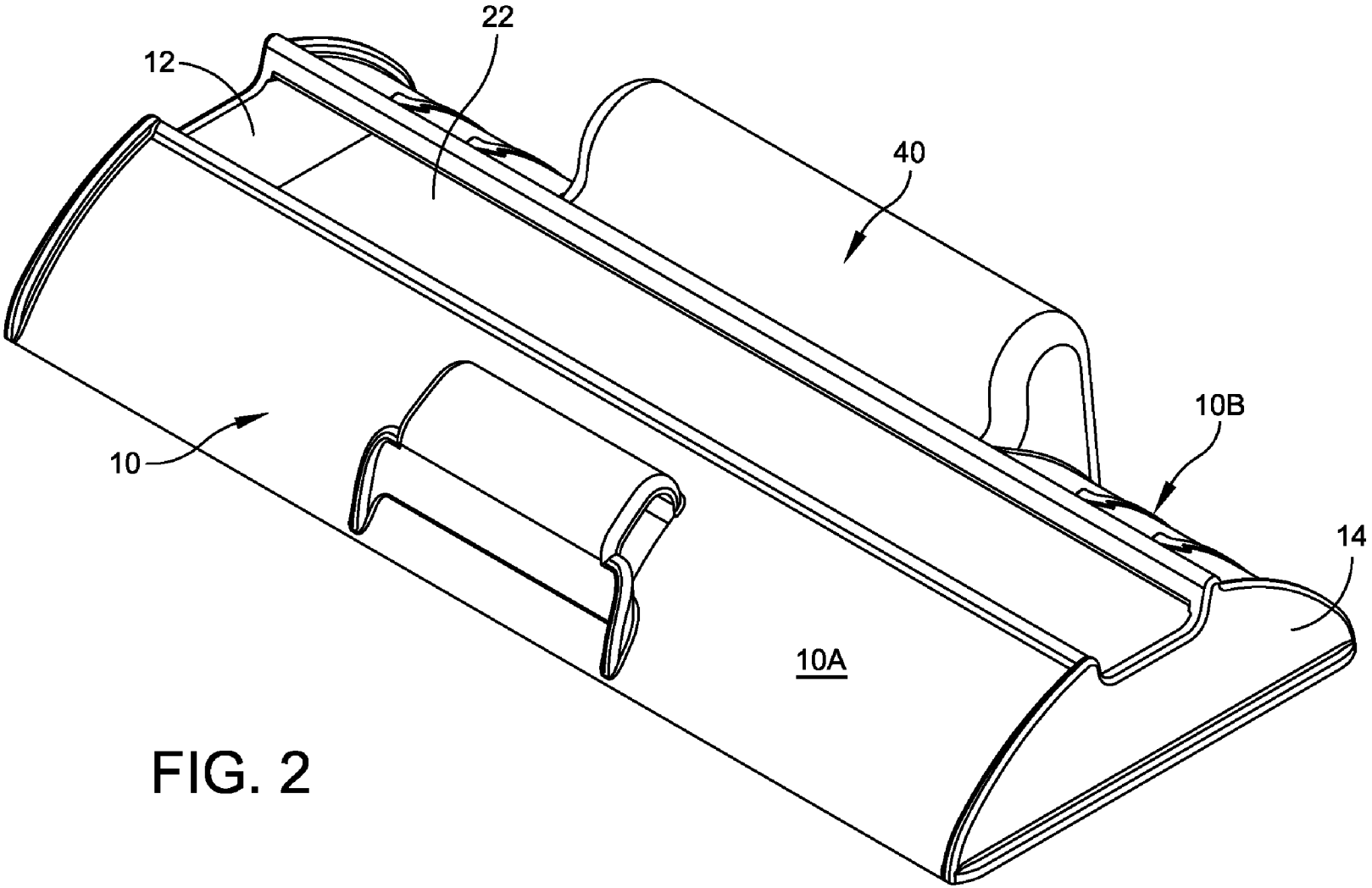
FIG. 2 is a perspective view of the roll container without the metal roll.
Figure 3:
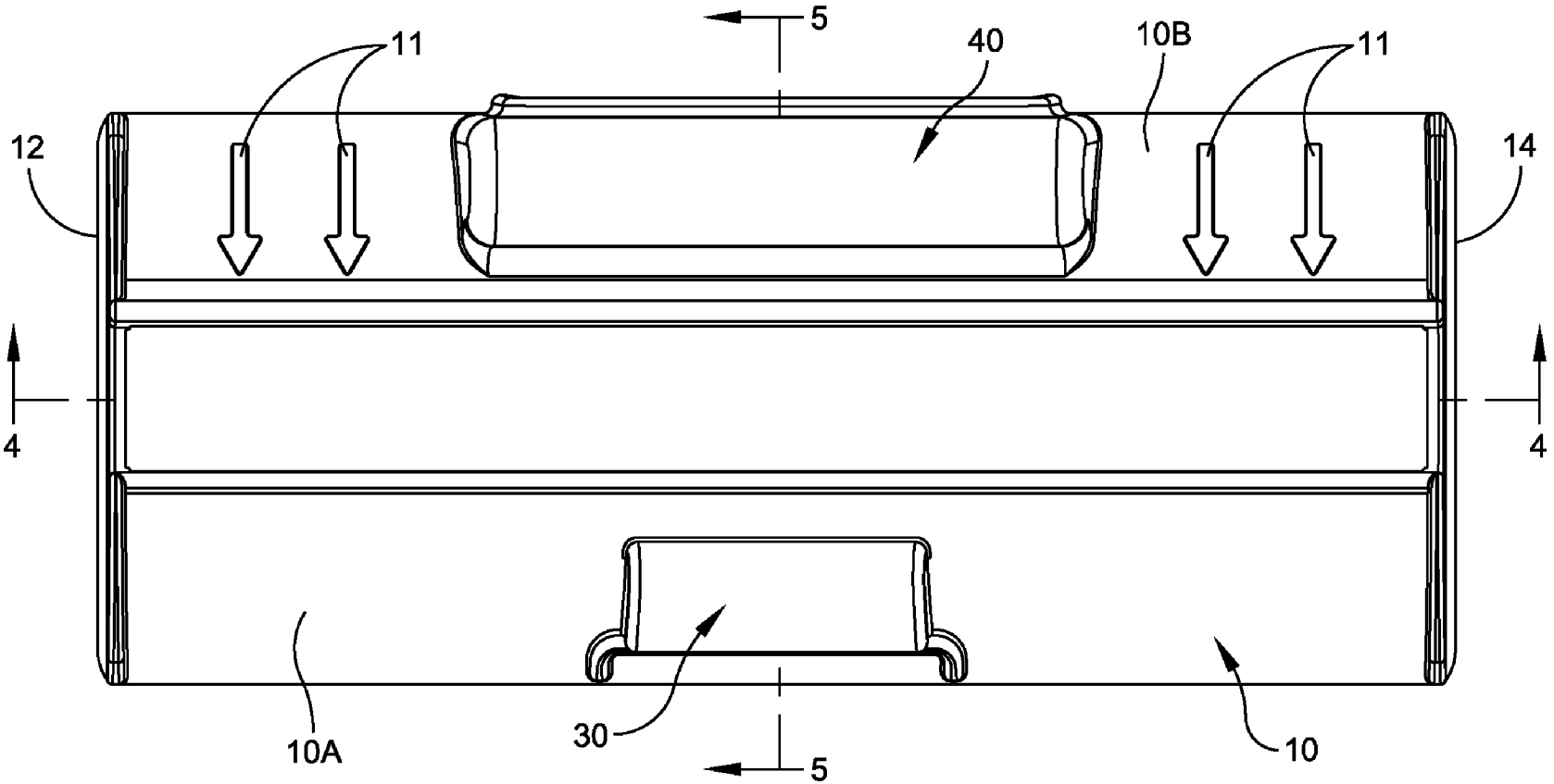
FIG. 3 is a plan view of the roll container.
Figure 4:
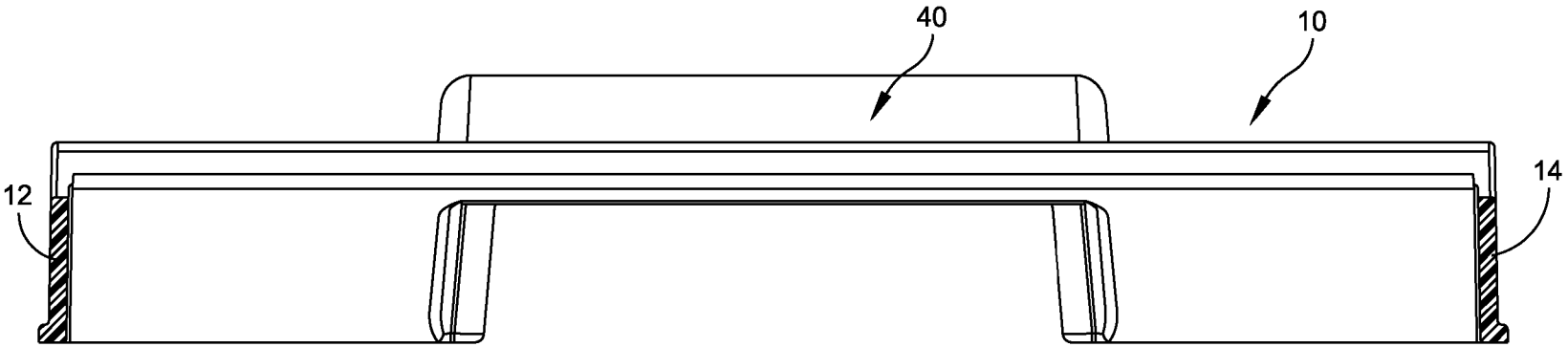
FIG. 4 is a cross-sectional view taken along line 4-4 of FIG. 3.

The cord 24 is an elastic cord and, as illustrated in FIGS. 1 and 2, ends of the elastic cord may be supported in a first cord holder 30. The holder 30 is defined by a protruding cap with a through passage 32. Respective ends of the cord may be tied together within the passage 32. The cord 24 is preferably fixedly secured to this first holder 30. The first holder 30 is secured to or integrally formed with the first base segment 10A. The entire base, along with the associated holders are preferably constructed by a single molding process. Refer to the cross-sectional view of FIG. 5 that shows the cross-section of the holder 30 and also refer to the cross-sectional view of FIG. 6 which depicts the elastic cord 24 captured within the passage 32 of the holder 30.

There is also provided a second cord holder 40 attached to the second base segment 10B and integrally formed therewith. The second cord holder is for releasably holding the elongated elastic cord 24. Refer to FIG. 1 that shows the cord 24 wrapped about the metal roll 20 and engaged at 24A with the holder 40. Refer also to the cross-sectional views of FIGS. 5 and 6 for the cross-sectional configuration of the holder 40. FIG. 6 also illustrates the cord segment 24A captured by the holder 40.

This second holder 40 is comprised primarily of a projection 42 that extends somewhat radially from the second base segment. The projection 42 has on one side thereof an indentation lip 44 for receiving the elastic cord 24. Once again, FIG. 1 depicts the elastic cord in place captured by the second holder 40 with that segment of the electric cord engaged behind the lip of the holder 40.

Figure 5:
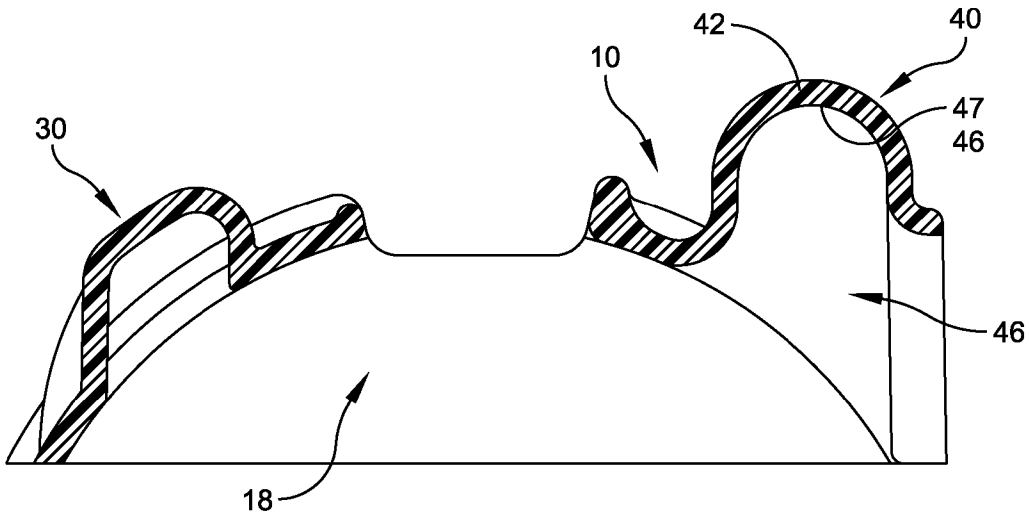
FIG. 5 is a cross-sectional view taken along line 5-5 of FIG. 3.
Figure 6:
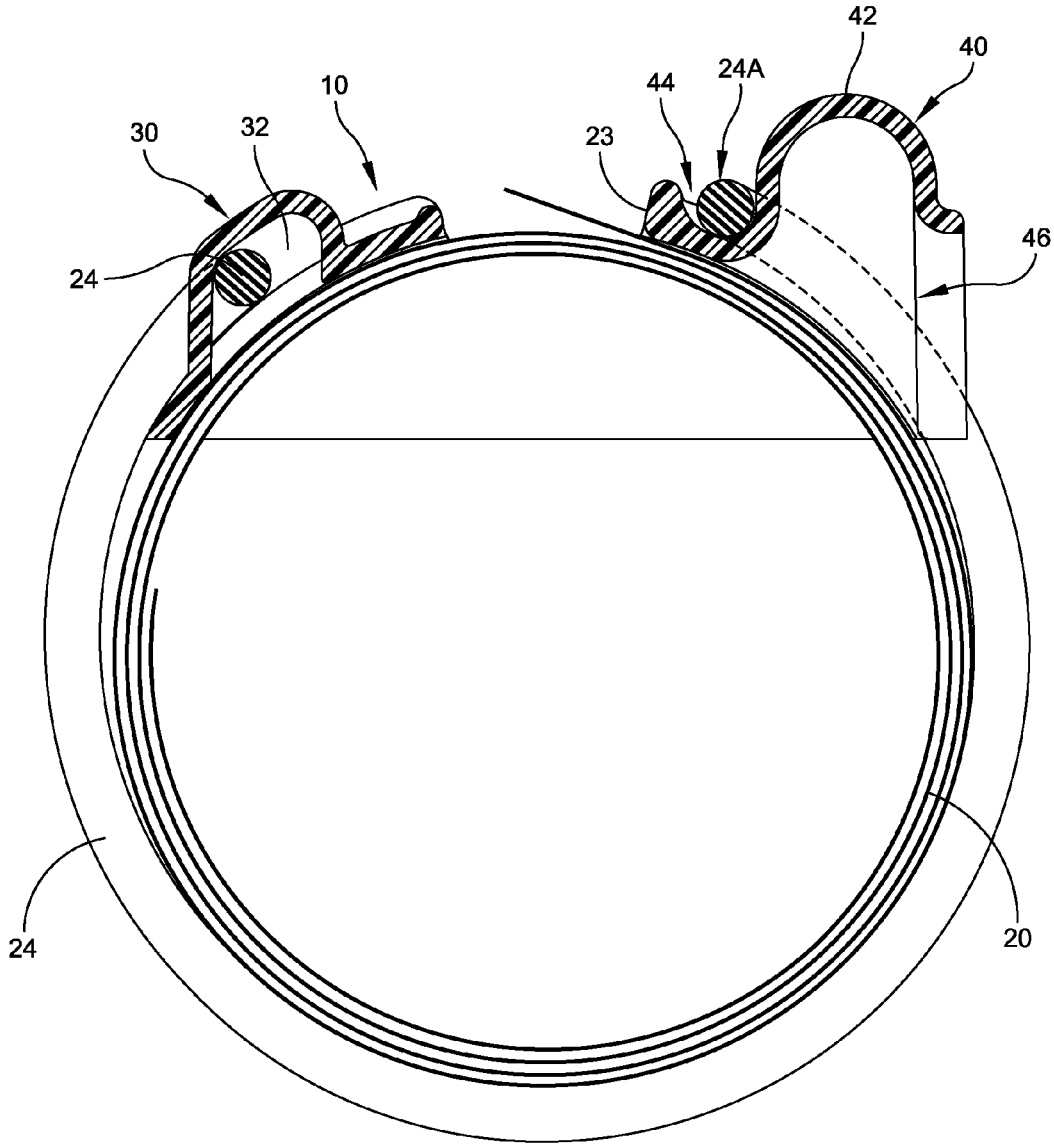
FIG. 6 is a cross-sectional view taken along line 6-6 of FIG. 1.

Another feature associated with the holder 40 is that along a substantial length thereof, it is provided with an opening 46 as shown in FIGS. 5 and 6. In this way the holder 40 can function as a handle for lifting the base as well as the supported sheet metal roll. The opening or indentation 46 may have a height of about one inch and may have a length of 4-6 inches. The inner surface 47 of the holder functions as a location for the user's fingers.

Figure 7:
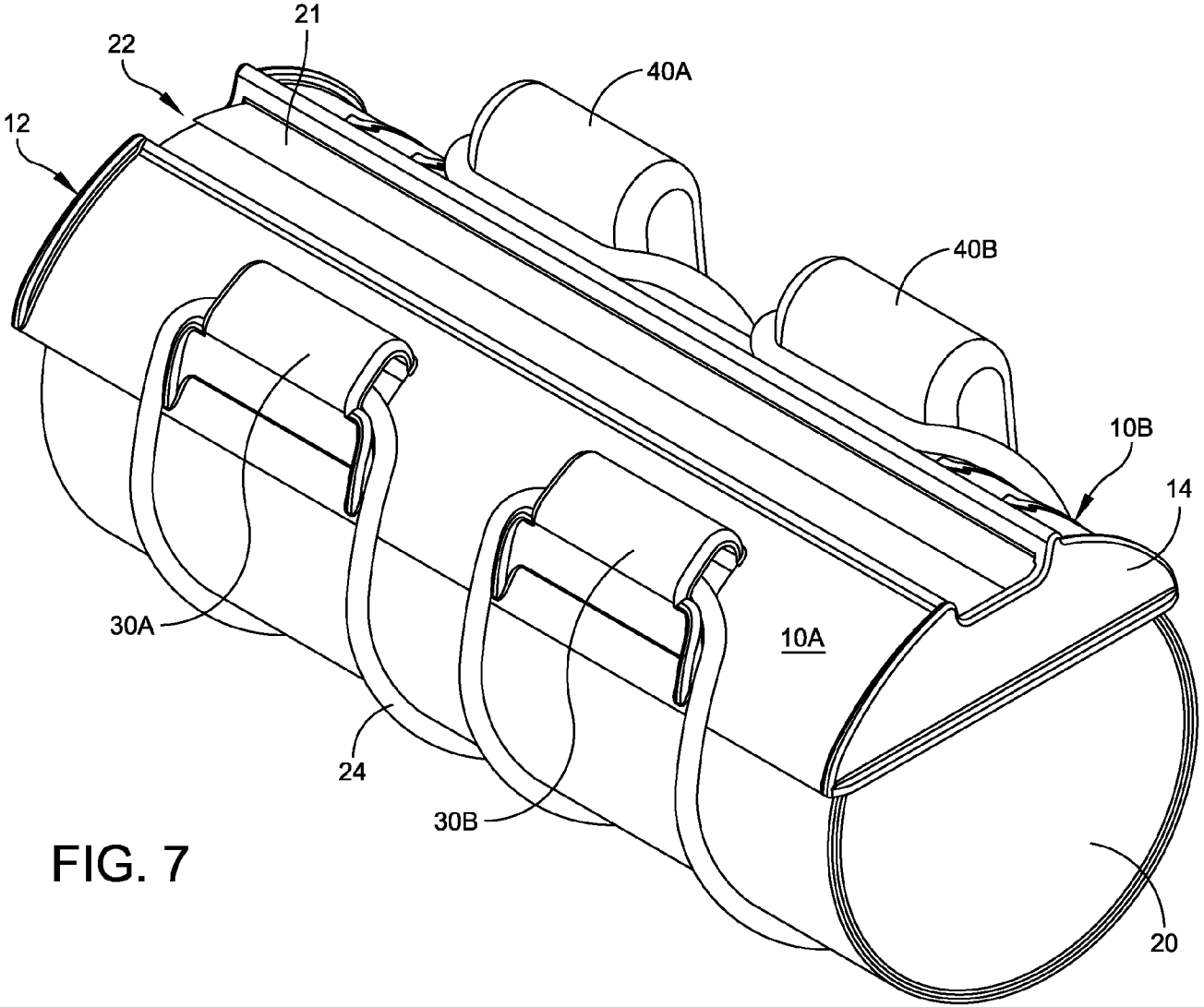
FIG. 7 is a perspective view similar to that shown in FIG. 1 but for an alternate embodiment of the invention.

Reference is now made to an alternate embodiment of the present invention illustrated in the perspective view of FIG. 7. In FIG. 7 some of the same reference characters are used as previously identified in FIG. 1. The embodiment of FIG. 7 employs a pair of first holders 30A and 30B. Respective ends of separate elastic cords may be secured in these holders 30A and 30B or the elastic cord may extend between the holders 30A and 30B. On the other base segment 10B are provided a pair of second holders 40A and 40B. Both the holders 30A and 30B, as well as the holders 40A and 40B, are preferably spacedly disposed along the surface of their respective base segments. As in the first embodiment in FIG. 1, the elastic cord 24 is shown being captured by both of the second holders. In still another embodiment, the holder pairs 30A and 30B; 40A and 40B may be provided with a single elastic cord. In that case the ends of the elastic cord are respectively secured to holders 30A, 30B. In a further embodiment a pair of holders 30A, 30B may be used with a single holder 40 (as in FIG. 1).

Having now described a limited number of embodiments of the present invention, it should now be apparent to those skilled in the art that numerous other embodiments and modifications thereof are contemplated as falling within the scope of the present invention, as defined by the appended claims.

The invention claimed is:

1. A container for a roll of material, said container comprising:

a partially circular base and oppositely disposed end walls that are integrally formed with the base and that define with the base an open channel in which the roll of material is to be placed;

an elongated slot provided along said base and dimensioned so as to receive therethrough an end of the roll of sheet material for dispensing thereof; and an elongated elastic cord attached at opposite sides of the base and extending about the roll of material for holding the roll of material in the open channel.

2. The container of claim 1 wherein the elongated slot extends from one end wall to the opposite end wall.

3. The container of claim 2 wherein the elongated slot divides the base into semi-circular first and second base segments.

4. The container of claim 3 including a first cord holder attached to the first base segment for retaining the elongated elastic cord.

5. The container of claim 4 further including a second cord holder attached to the second base segment for releasably holding the elongated elastic cord.

6. The container of claim 5 including a pair of second cord holders that are spacedly disposed.

7. The container of claim 6 wherein each second cord holder has a projection that extends radially from the second base segment, and each projection has on one side thereof a lip for receiving the elastic cord.

8. The container of claim 5 wherein the second cord holder comprises a projection that extends radially from the second base segment.

9. The container of claim 8 wherein the projection has on one side thereof a lip for receiving the elastic cord.

10. The container of claim 9 wherein the projection has on another side thereof an indentation that forms a carry handle.

11. The container of claim 4 wherein the first cord holder has a through passage for receiving ends of the elongated elastic cord so as to retain the ends in place.

12. The container of claim 9 including a pair of first holder that are spacedly disposed and that each have a through passage.

13. The container of claim 12 wherein the projection has on another side thereof an indentation that forms a carry handle.

14. The container of claim 4 wherein the first cord holder has a through passage for receiving ends of the elongated elastic cord so as to retain the ends in place.

15. The container of claim 9 wherein the elongated elastic cord has a free end that is looped over the projection and retained by the projection lip.

16. A method of supporting and dispensing sheet metal from a roll that is disposed in a container for the roll, comprising the steps of:

providing a partially circular base and oppositely disposed end walls that are integrally formed with the base and that define with the base an open channel and having an elongated slot provided along said base;

placing said roll into said base with the slot constructed and arranged so as to receive therethrough an end of the roll of sheet material for dispensing thereof; and and having an elongated elastic cord attached at opposite sides of the base and extending about the roll of material for holding the roll of material in the open channel.

17. The method of claim 16 wherein the elongated slot divides the base into semi-circular first and second base segments, and attaching the cord a first cord holder for retaining the elongated elastic cord.

18. The method of claim 17 including a second cord holder attached to the second base segment for releasably holding the elongated elastic cord.

19. The method of claim 18 wherein the second cord holder comprises a projection that extends radially from the second base segment.

20. The method of claim 19 wherein the projection has on one side thereof a lip for receiving the elastic cord.

21. The container of claim 20 wherein the projection has on another side thereof an indentation that forms a carry handle.

* * * * *